US005253765A

United States Patent [19]

Moorehead et al.

[11] Patent Number: 5,253,765

[45] Date of Patent: Oct. 19, 1993

[54] SORTING AND GRADING SYSTEM

[75] Inventors: Robert M. Moorehead, South Beach, Oreg.; John K. Anderson, Garland; Charles E. Jeske, Plano, both of Tex.

[73] Assignee: L.M.B. Electronics, Inc., Richardson, Tex.

[21] Appl. No.: 4,701

[22] Filed: Jan. 14, 1993

[51] Int. Cl.[5] ..... B07C 5/02

[52] U.S. Cl. ..... 209/539; 209/586; 209/587; 209/921; 250/223 R; 250/560; 382/8; 382/25; 358/101; 198/454

[58] Field of Search ..... 209/539, 598, 586, 587, 209/921; 198/452, 453, 454; 250/223, 560; 382/8, 22, 25, 28; 358/101

[56] References Cited

U.S. PATENT DOCUMENTS

| | | | |
|---|---|---|---|
| 4,324,335 | 4/1982 | Conway et al. | 209/586 |
| 4,351,437 | 9/1982 | Long | 250/560 X |
| 4,457,434 | 7/1984 | Brown et al. | 209/539 |
| 4,624,367 | 11/1986 | Shafer et al. | 382/25 X |
| 4,693,378 | 9/1987 | Azegami et al. | 382/28 X |
| 4,735,323 | 8/1988 | Okada et al. | 209/582 |
| 4,963,035 | 10/1990 | McCarthy et al. | 382/28 |
| 5,058,749 | 10/1991 | Jong | 209/539 |
| 5,060,290 | 10/1991 | Kelly et al. | 382/18 |
| 5,111,926 | 5/1992 | Long | 209/539 X |
| 5,134,291 | 7/1992 | Ruhl, Jr. et al. | 209/587 X |
| 5,184,733 | 2/1993 | Arnarson et al. | 209/939 X |

FOREIGN PATENT DOCUMENTS

| | | | |
|---|---|---|---|
| 0089212 | 9/1983 | European Pat. Off. | 209/586 |
| 0037778 | 3/1979 | Japan | 209/586 |

OTHER PUBLICATIONS

Jain, Anil K., *Fundamentals of Digital Image Processing*, Prentice-Hall, Inc., pp. 378-381, 1989.

Gonzalez, Rafael C., and Wintz, Paul, *Digital Image Processing*, 2nd Edition, Addison-Wesley Publishing Co., pp. 419-423, 1987.

*Primary Examiner*—M. Grant Skaggs
*Assistant Examiner*—Carol L. Druzbick
*Attorney, Agent, or Firm*—Ross, Howison, Clapp & Korn

[57] ABSTRACT

A system for sorting randomly oriented objects of various sizes based upon the size of the object includes a transport for conveying a series of objects from an input location to one of a plurality of output locations. An image system is disposed along the transport for capturing the image of each object to be sorted. An image processor detects the minimum and maximum linear dimension of each object based upon the captured image. The image processor further determines the shape of each object based upon the captured image. The minimum or maximum linear dimension is selected based upon the shape of the object. The object is categorized by size based upon the selected minimum or maximum dimension. Structure is provided for selectively routing the object based upon the categorized object size to one of the plurality of output locations.

20 Claims, 7 Drawing Sheets

SORTING AND GRADING SYSTEM

TECHNICAL FIELD OF THE INVENTION

The present invention relates to grading and sorting systems, and more particularly to a system for automatically grading and sorting randomly oriented objects of varying sizes and shapes.

BACKGROUND OF THE INVENTION

It is often desired to sort objects based upon size characteristics. Sorting, if done by human operators, is very time consuming and labor intensive. Therefore, it is desirable to provide systems for automatically grading and sorting objects without the need of human intervention to provide lower labor costs, higher quality, and more uniform product grading.

Sorting systems in which the objects vary in size, shape, as well as orientation create additional problems in the grading process. For example, in the process of grading and sorting mushrooms, it is desirable to grade and sort based upon the diameter of the mushroom cap. Since the mushroom is composed of the cap and stem, various dimensions are presented to an automatic sort system which must be distinguished in order to properly grade a mushroom. Such an automatic system must therefore detect the difference between the mushroom cap and stem in order to properly detect various sizes of mushroom caps. Since the mushrooms in an automatic system will be oriented randomly, such as, for example, stem upwardly directed; cap upwardly directed; or both cap and stem visible, the system must perform grading independent of the orientation of the mushroom within the system.

A need has thus arisen for an automatic system for sorting randomly oriented objects of varying sizes, such as for example, mushrooms, into various categories of sizes. Such a system must provide for rapid throughput as well as for an accurate determination of object sizes independent of object orientation travelling through the system.

SUMMARY OF THE INVENTION

In accordance with the present invention, a system for sorting randomly oriented objects of various sizes based upon the size of the object is provided. The system includes a transport for conveying a series of objects from an input location to one of a plurality of output locations. An image system is provided and is disposed along the transport for capturing the image of each object to be sorted. An image processor detects the minimum and maximum linear dimension of each object based upon the captured image. The image processor further determines the shape of each object based upon the captured image. The minimum or maximum linear dimension is selected based upon the shape of the object. The object is categorized by size based upon the selected minimum or maximum dimension. Structure is provided for selectively routing the object based upon the categorized object size to one of the plurality of output locations.

In accordance with another aspect of the present invention, a transport for conveying a series of randomly oriented objects to be sorted based upon size is provided. The transport includes structure for receiving and transporting a plurality of objects arranged in a volume from an input location. A conveyor is provided for receiving and transporting the volume of objects and for arranging the objects in a one dimensional layer of objects to be sorted. An additional conveyor receives and transports the layer of objects to be sorted and orients the objects into a linear array. The structure for orienting the objects into a linear array comprises a chute having a generally U-shaped cross-sectional shape. Conveyors are further provided for transporting the objects to one of a plurality of output locations based upon the size of the objects.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
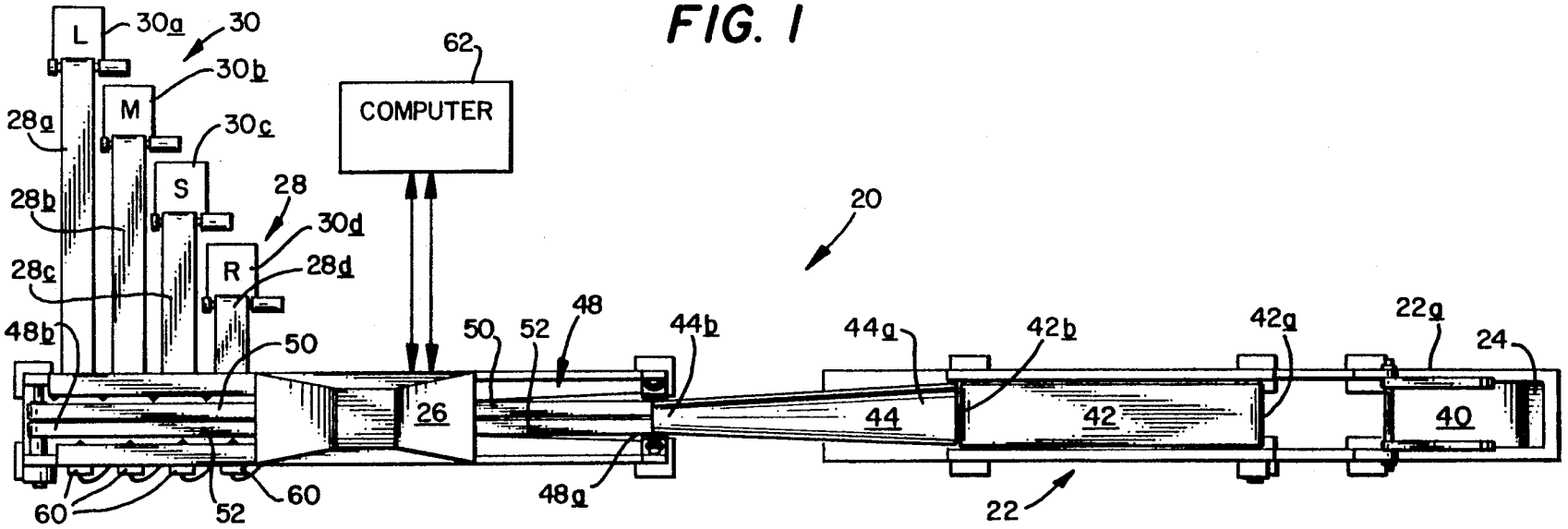
FIG. 1 is a top plan view of the present sorting and grading system.
Figure 2:
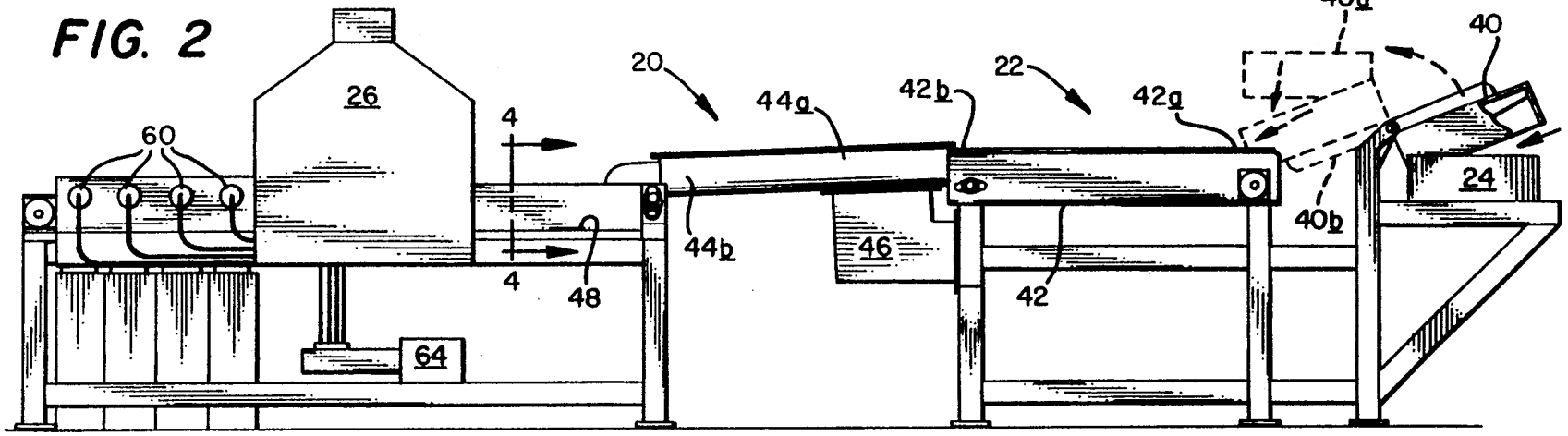
FIG. 2 is a side elevational view of the present sorting and grading system illustrated in FIG. 1.

Referring simultaneously to FIGS. 1 and 2, the present automatic sorting and grading system is illustrated, and is generally identified by the numeral 20. The present system 20 may be utilized for grading and sorting randomly oriented objects such as, for example, fasteners, nuts, bolts, screws, fruits, vegetables, or the like. The present system 20 will be subsequently described with respect to FIGS. 3–10 for the processing of mushrooms; however, there is no intent to limit the use of the present invention to the sorting of mushrooms, it being understood that the use of mushrooms as the objects to be graded and sorted is for illustration purposes only.

System 20 includes a transport, generally identified by the numeral 22, for receiving objects from an input supply source 24, and for transporting these objects to an image capture system, generally identified by the numeral 26. Once the objects have been graded by image capture system 26, the objects are transported by an output transport, generally identified by the numeral 28, to a plurality of output locations 30, representing storage facilities for objects of various sizes. For example, output locations 30*a*, 30*b*, 30*c*, and 30*d* may represent, for example, large, medium, small sized objects, and reject objects, respectively.

Input supply source 24 may comprise, for example, in the instance where the objects are mushrooms, a tray or "wire" which is disposed at end 22a of transport 22. A wire loading conveyor 40 transports the tray 24 at end 22a of transport 22 and dumps the contents of tray 24 onto a loading conveyor 42. Wire loading conveyor 40 is shown in FIG. 2 in various positions 40a and 40b to illustrate that the contents of tray 24 are rotated to be dumped onto the surface of loading conveyor 42. The objects to be sorted constitute a volume when present on loading conveyor 42 and are oriented in a random orientation with multiple layers of objects. Loading conveyor 42 functions to orientate the objects into a one dimensional layer of objects as the objects move from end 42a of conveyor 42 to end 42b of conveyor 42.

The objects are then received and transported via a conveyor 44 having an input end 44a and an output end 44b. Input end 44a is larger in width than output end 44b, such that conveyor 44 functions to orient the one dimensional layer of objects received at end 44a into a linear array of objects to be output at end 44b. As more clearly shown in FIG. 4, conveyor 44 has a generally U-shaped cross-sectional shape to facilitate the linear orientation of objects to be sorted. Additionally, conveyor 44 may be vibrated utilizing a vibration system 46 to assist in the transport of objects from end 42b of conveyor 42 to end 44b of conveyor 44.

The objects now orientated in a single linear array at end 44b are then received by an input conveyor 48 having ends 48a and 48b. Input conveyor 48 includes conveyor belts 50 and 52. Conveyor belts 50 and 52 are slightly canted inwardly upstream of image capture system 26. Belts 50 and 52 are horizontally disposed downstream of system 26 after images of objects have been captured by image capture system 26.

Output transport 28 includes a plurality of conveyor belts 28a, 28b, 28c, and 28d, corresponding to output locations 30a, 30b, 30c, and 30d, respectively. Output transport 28 is disposed generally perpendicular to input conveyor 48 at end 48b and is disposed in a plane below the plane containing input conveyor 48. Disposed along input conveyor 48 at end 48b are diverters 60 for causing an object to move from the surface of input conveyor 48 to the surface of one of the conveyor belts 28a, 28b, 28c, or 28d for deposit to an output location 30. The actuation of diverter 60 is controlled by a computer 62 which functions to also control image capture system 26, transport 22, including wire loading conveyor 40, loading conveyor 42, vibratory conveyor 44, input conveyor 48, and output transport 28.

Diverter 60, may comprise, for example, sources of low pressure air applied through a jet under operation of a diverter control 64.

Figure 3A:
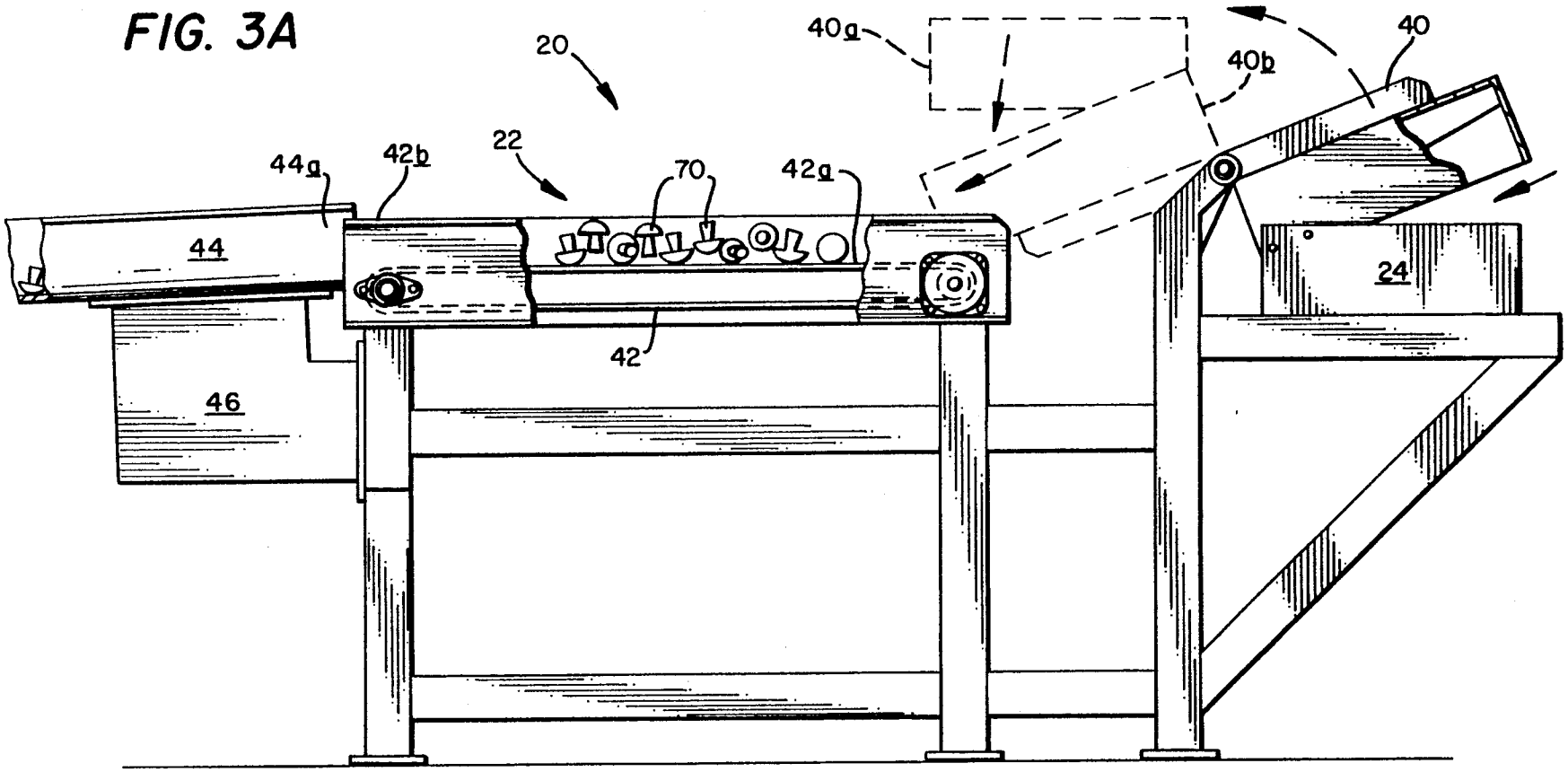
FIGS. 3*a* and 3*b* illustrate a side elevational view of the present sorting and grading system for use in the sorting and grading of mushrooms.
Figures 3B, 4:
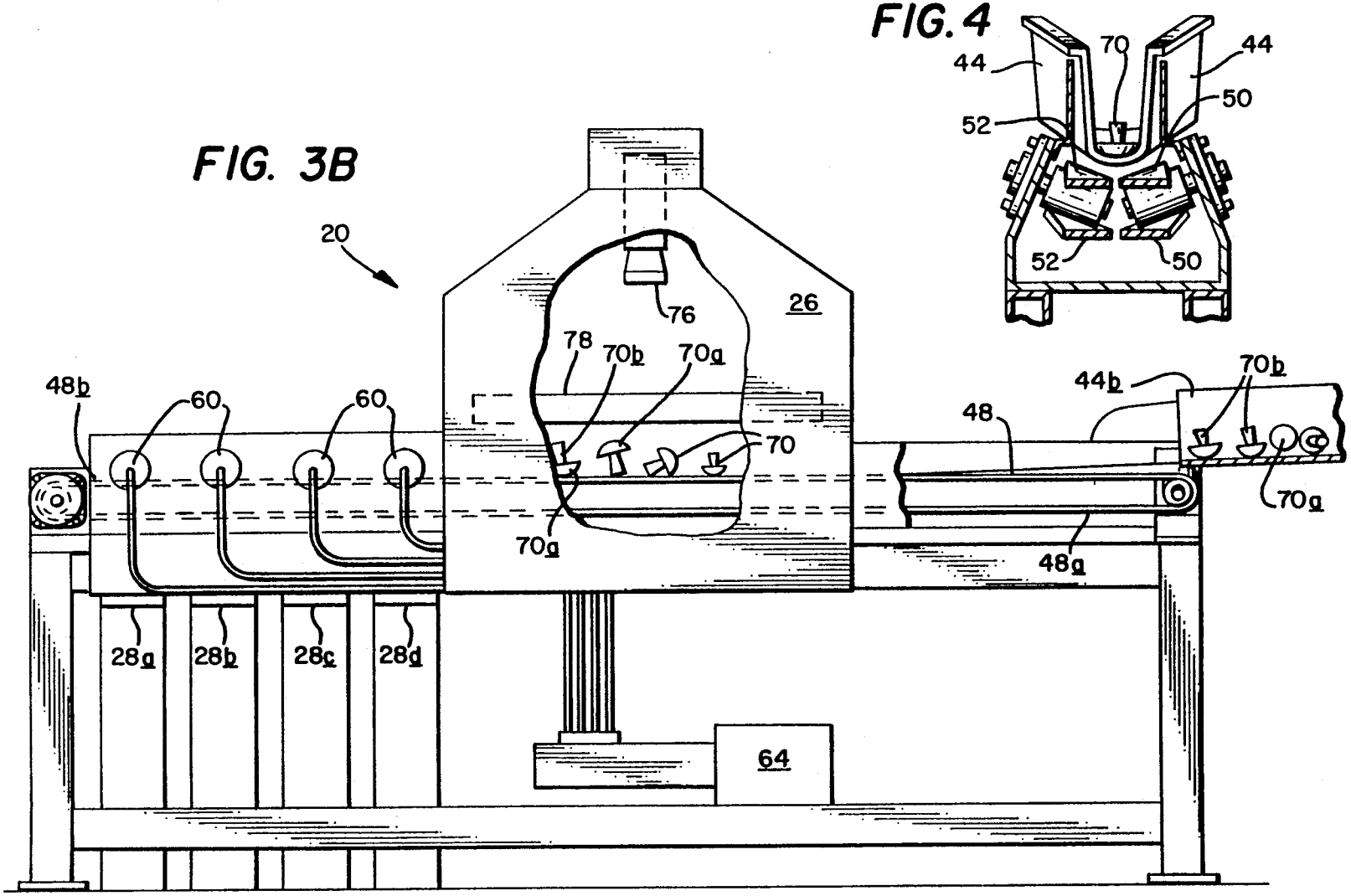
FIG. 4 is a cross-sectional view taken generally along section lines 4—4 of FIG. 2.
Figure 5:
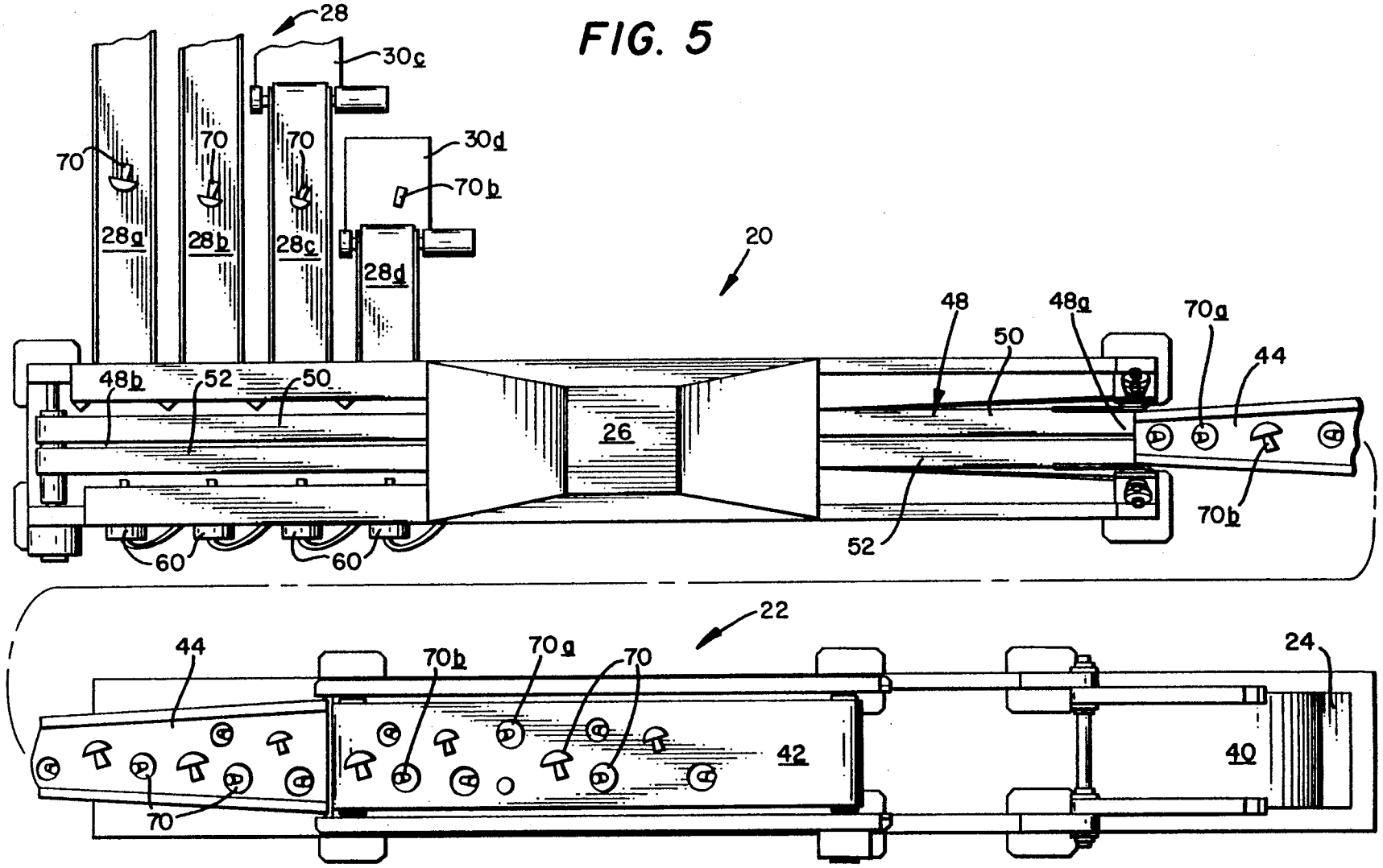
FIG. 5 is a top plan view of the present sorting and grading system corresponding to FIGS. 3*a* and 3*b;*

Referring now simultaneously to FIGS. 3a, 3b, 4 and 5, wherein like numerals are utilized for like and corresponding components previously identified with respect to FIGS. 1 and 2, the present system 20 is illustrated for use to sort and grade mushrooms. As illustrated in FIG. 3a, load conveyor 42 includes a plurality of randomly disposed mushrooms 70, which due to operation of load conveyor 42, become oriented in a single layer as illustrated in FIG. 3b. Mushrooms 70 are then arranged into a linear array through the operation of vibratory conveyor 44, such that a single row of mushrooms 70 are deposited onto input conveyor 48 as shown in FIGS. 3b and 5. The random orientation of mushrooms 70 are then transported to image capture system 26 via input conveyor 48. As seen in FIG. 3b, the mushrooms 70 may be oriented with cap 70a adjacent to belts 50 and 52, spaced apart from belts 50 and 52, or stem 70b may disposed adjacent to belts 50 and 52 or spaced apart from belts 50 or 52. Additionally, both cap 70a and stem 70b may lie adjacent to belts 50 and 52.

Image capture system 26 includes a camera 76 and an illumination source 78. Camera 76 may comprise, for example, a model KP-M1, black and white CCD Camera manufactured and sold by Hitachi Denshi, Ltd. for capturing the image of mushroom 70 along input conveyor 48. The operation of camera 76 will be subsequently described in connection with FIGS. 6 and 7. It is important to note, that the present system 20 operates to grade and sort mushrooms 70 disposed on conveyor 48 in various orientations as illustrated in FIG. 3b, and functions regardless of this orientation.

Figure 6:
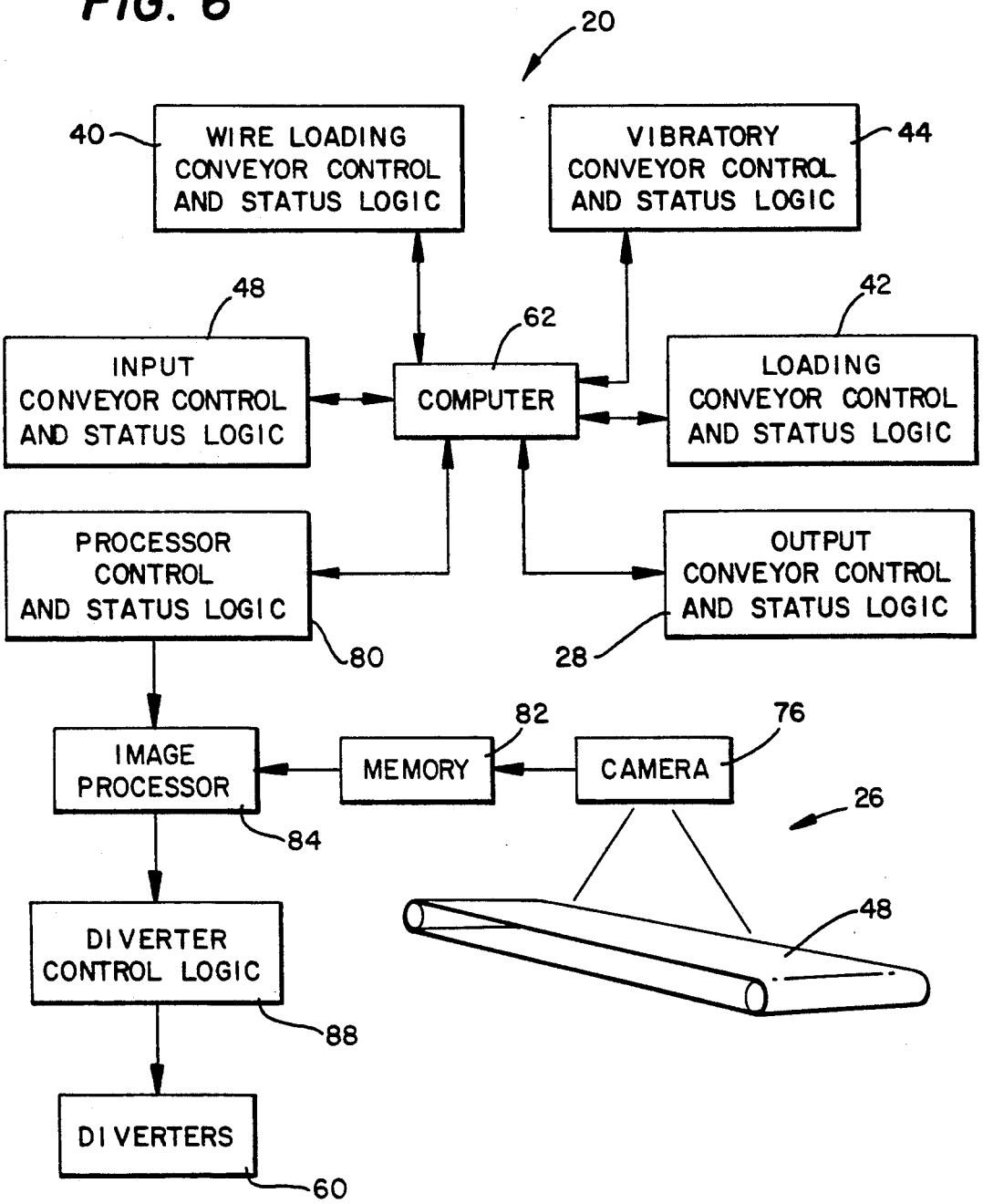
FIG. 6 is a schematic block diagram of the present sorting and grading system.

FIG. 6 illustrates a block diagram of the present system 20 illustrating the control and status logic for each of the conveyors comprising transport 22, as well as output transport 28. Each conveyor 28, 40, 42, 44 and 48 operates under the control of computer 62. Inputs to computer 62 are supplied via an operator console for selecting parameters such as, for example, conveyor speeds and criteria utilized for determining size parameters for the objects to be sorted. Image capture system 26 also operates under the control of computer 62, and includes control and status logic 80. Camera 76 operates in conjunction with a PC-based frame grabber card which provides digitization of the image captured by camera 76 and which places the image data into a memory 82 for subsequent processing by an image processor 84. The frame grabber card associated with camera 76 and image processor 84 may comprise, for example, a model P 360 Power Grabber® board manufactured and sold by Dipix Technologies, Inc., Board Products Division, Ottawa, Ontario, Canada. The interface between camera 76 and the frame grabber is well known to those skilled in the art and may comprise, for example, an RS 170 standard. The camera 76 formats the output of its CCD array into RS 170 standard for transmission to the frame grabber card which then transforms the RS 170 signal into digital form for storage in memory 82.

The output of image processor 84 generates control signals to diverter control logic 88 for controlling the actuation of diverters 60.

Figure 7:
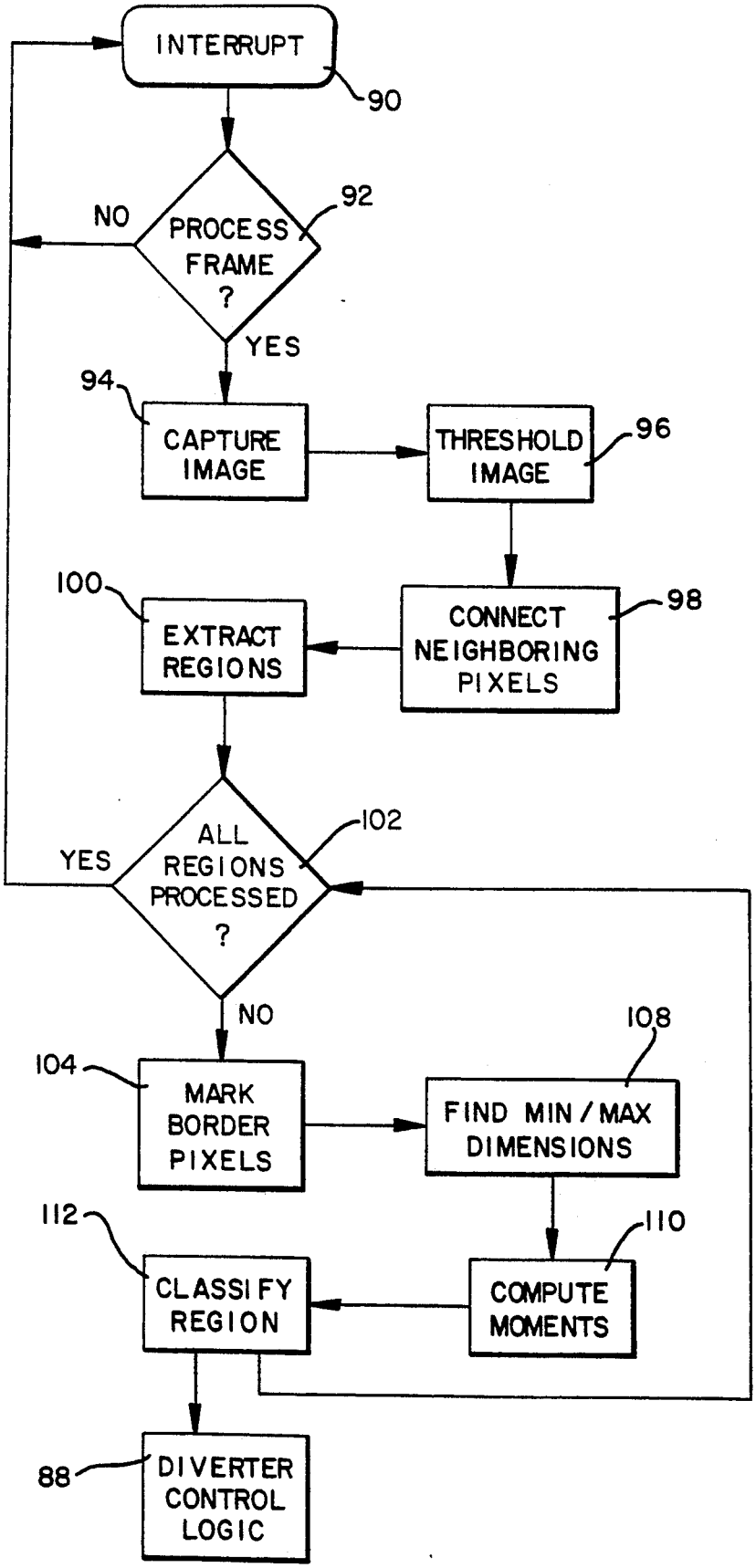
FIG. 7 is a software flow diagram of the computer software utilized with the present sorting and grading system.

Referring now to FIG. 7, a flow diagram illustrating the software associated with computer 62 for the determination of size of objects to be sorted utilizing the present system 20 is illustrated. An important aspect of the present invention is determining the size of mushrooms 70 regardless of their orientation along input conveyor 48 and their shape. A feature utilized to determine the size of a mushroom 70 is the diameter of the cap 70a.

An interrupt is generated at block 90 through operation of camera 76 to indicate that a sufficient time period has elapsed in order for the camera 76 to capture the images of a plurality of mushrooms 70 passing under camera 76 and to allow sufficient time for image processor 84 to process all mushrooms in the image captured. At block 92 a decision is made as to whether a frame should be processed. A frame of data represents several mushrooms 70 being viewed by camera 76. If it is determined that a frame should be processed, camera 76 captures the image of the plurality of mushrooms located on input conveyor 48 within a field of view of camera 76. The image is captured at block 94 and the picture elements (pixels) are stored within memory 82 (FIG. 6). The pixels represent values proportional to the brightness of the area imaged by camera 76. The present system 20 utilizes changes in brightness to identify pixels comprising the objects to be sorted. At block 96, the image pixels above a threshold value are classified as pixels representing the object, while those which are below the threshold value are classified as background pixels. The background pixels are ignored.

The threshold value is calculated during a training phase of system 20. The training phase is entered upon initiation of computer 62. The mushrooms 70 represent a white object travelling on a dark background represented by conveyor belts 50 and 52. If an estimate of the brightness value of belts 50 and 52 can be made, any pixel whose value is above this estimate must be foreign to conveyor belts 50 and 52 and is therefore considered an object pixel. A histogram of the conveyor belts 50 and 52 is computed to estimate the brightness value of the conveyor. The histogram is the frequency or occurrence distribution of gray levels. The histogram tracks the number of times each of the pixel values occur. The entire surface of conveyor belts 50 and 52 is imaged and histogrammed for consecutive frames.

Once the object pixels have been identified, the neighboring pixels are connected at block 98. The threshold image of the mushroom 70 is converted into regions using connectivity analysis at block 98. Pixels are "connected" if they are sufficiently close in the spatial and brightness sense. The present system 20 uses, for example, four closest neighbors as the discriminating factor in the spatial sense. Any pixel above the threshold at block 96 is considered an object pixel which is the deciding factor in the brightness sense.

Once the pixels have been connected at block 98, specific regions are extracted at block 100. Region extraction allows for the processing of a single mushroom 70 where images of multiple mushrooms may have been captured within a frame. At block 100, the image is divided into regions and each region is removed from the full frame image, thereby allowing pixels representing a single mushroom 70 to be separately stored. This storage improves performance by reducing the complexity of the memory access as well as allowing for pipelining and parallel processing.

A decision is made at block 102 as to whether or not all regions have been processed. If a region has not been processed, pixel information is provided in order to determine the border of the mushroom 70 at block 104. At block 104, the boundary of a mushroom 70 is defined. To decrease computational time, a boundary of the mushroom 70 is marked so that only those pixels which define the mushroom size will be used for size computation. The border pixels are pixels which have at least one background pixel as one of its four closest neighbors.

Figure 8:
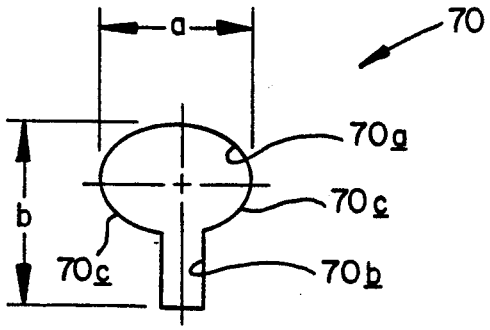
FIG. 8 is a pictorial representation of a mushroom showing minimum and maximum linear dimensions.

At block 108, the minimum and maximum dimensions of a mushroom 70 are determined utilizing the border pixels identified at block 104. The minimum and maximum dimensions of a mushroom are illustrated in FIG. 8 as reference characters a and b, respectively. The border pixels are represented by reference numeral 70*c*.

Figure 9:
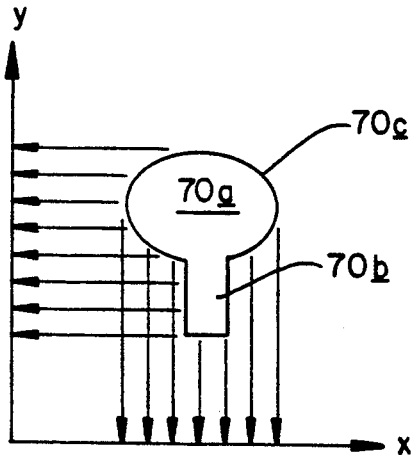
FIG. 9 is a pictorial representation of a mushroom illustrating the formation of minimum and maximum linear projections utilized in the grading process.
Figure 10:
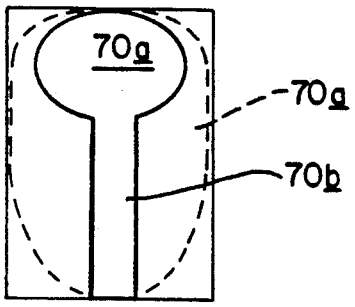
FIG. 10 is a pictorial representation of mushrooms in various orientations.

System 20 utilizes the concept that a mushroom 70 has only one maximum dimension, b, and one minimum dimension, a. Further, the maximum dimension will be parallel or perpendicular to stem 70*b* while the minimum dimension will always be perpendicular to the maximum dimension. At block 108, the system 20 software determines values for dimensions a and b by causing the border pixels of mushroom 70 to create a projection as illustrated in FIG. 9. For each rotation angle of the border pixels, a projection is created. The distance from the maximum extreme to the minimum extreme defines the dimension for the image at that rotation angle. As the image is rotated through 180°, the maximum and Even though the maximum and minimum dimensions are now determined, it is unknown as to whether the maximum dimension runs perpendicular to a mushroom stem 70*b*. Knowing the dimensions of a boundary box surrounding a mushroom 70 does not provide sufficient information to define the size of the enclosed mushroom 70. Given a maximum and minimum combination, two mushrooms 70 may be drawn inside the boundary box as illustrated in FIG. 10. For example, the maximum dimension, b, may represent the size of the cap and stem combination, in which case the minimum dimension is the true indication of the size of the mushroom. If the minimum dimension represents the size of the cap and stem, the maximum dimension of the mushroom will be utilized for identifying the size of the mushroom. Therefore, in order to determine the size of the mushroom, shape information must be considered in the decision process.

At block 110, (FIG. 7), the software associated with system 20 computes the invariant moments of a mushroom 70 utilizing the complete pixel information contained within the border of a captured image. The invariant moment provides spatial information about the region contained within the border pixels independent of mushroom size, rotation, or translation. Based upon the value of the invariant moments, the maximum or minimum dimension, b or a, (FIG. 8) is chosen as the diameter of the mushroom cap 70*a*. Once the invariant moment has been computed, the output maximum or minimum dimension is applied to block 112, for region classification.

Invariant moment computation is described in references such as, for example, Jain, Anil, K., *Fundamentals of Digital Image Processing,* Prentice Hall, Inc., 1989 pp. 378–381 and Gonzalez, Rafael, C., *Digital Image Processing,* Second Edition, Addison-Wesley Publishing Co., 1987 pp. 419–423, which are incorporated herein by reference. It has been determined empirically, that in the case for processing mushrooms, if the first invariant moment is greater than 0.182 and fourth invariant moment is greater than $3\times10^{-6}$, the minimum dimension, a, is selected as the diameter of mushroom cap 70*a*. If not, the maximum value, b, is utilized as the diameter of the mushroom cap 70*a*.

To summarize, block 110 calculates invariant moments of a mushroom 70 in order to provide spatial information concerning the shape of a mushroom 70. Once this shape information is known, the minimum or maximum dimension is selected to provide an indication of a size of a mushroom 70. The system 20 through operator selected parameters input to computer 62 allows for, for example, four boundary sizes for the following size categories, large, medium, small or reject, corresponding to the output locations 30*a*, 30*b*, 30*c* or 30*d*, respectively. Using the four boundary categories of sizes, the determined diameter of the mushroom cap is placed into this category at block 112. Each category has an associated output signal which is applied to diverter control logic 88 for actuating a diverter 60. Actuation of a diverter 60 transfers a mushroom 70 from conveyor 48 to a conveyor 28 for transport to an output location 30.

After a mushroom 70 has been classified, a decision is then made at block 102 (FIG. 7) to determine if all regions have been processed, if not, the border pixels for a particular mushroom 70 are processed and the size of a subsequent mushroom is determined. If all regions have been processed, the flow returns to interrupt block 90 for subsequent frame processing.

Therefore, it can be seen that the present invention determines the size of randomly oriented objects of varying sizes by grading the objects according to size based upon minimum and maximum dimensions of the object in combination with a determination of the shape of the object. Once the size has been determined, the objects are sorted based upon size categories. The objects such as, for example, mushrooms, are not subjected to rough handling as is common in manual systems. The mushrooms are in contact with soft surfaces of various conveyor transports and low pressure air generated by diverters. The present system offers lower costs, higher quality and uniform product sorting over manual sorting operations. User input determines the size categories and throughput of the system.

Whereas the present invention has bee described with respect to specific embodiments thereof, it will be understood that various changes and modifications will be suggested to one skilled in the art and it is intended to encompass such changes and modifications as fall within the scope of the appended claims.

We claim:

1. A system for sorting randomly oriented objects of varying sizes based upon the size of the object, the objects having minimum and maximum linear dimensions, the system comprising:

transport means for conveying the objects from an input location to one of a plurality of output locations;

means disposed along said transport means for capturing the image of each object to be sorted;

image processing means for determining the minimum and maximum linear dimension of each object based upon the captured image;

image processing means for determining the shape of each object based upon the captured image;

means for selecting either the minimum or maximum linear dimension of the object based upon the shape of the object;

means for categorizing the size of the objects based upon the selected minimum or maximum dimension and for generating a control signal;

means responsive to said control signal for selectively routing the object based upon the categorized object size to one of said plurality of output locations.

2. The system of claim 1 wherein said transport means includes:

means for receiving a plurality of objects arranged in a volume from the input location;

conveyor means for receiving said volume of objects and for arranging the objects into a one dimensional layer; and means for receiving said layer of objects and for orienting said objects into a linear array of objects.

3. The system of claim 2 wherein said means for receiving said layer of objects includes a chute having a generally U-shaped cross-sectional shape.

4. The system of claim 3 and further including:

means for vibrating said chute.

5. The system of claim 2 wherein said transport means further includes:

first and second conveyor belts angularly orientated with respect to each other for transporting said linear array of objects from said orienting means to a location adjacent to said image capture means.

6. The system of claim 1 wherein said means for selectively routing the objects includes:

a plurality of conveyor belts, each one of said plurality of conveyor belts transporting objects to one of said plurality of output locations, said plurality of conveyor belts being disposed generally perpendicular to said transport means; and means for diverting objects from said transport means to one of said plurality of conveyor belts.

7. The system of claim 6 wherein said diverting means includes:

a plurality of air jets, each associated with one of said plurality of conveyor belts.

8. The system of claim 1 wherein said image capture means includes:

means for representing the image of the object in picture elements, including boundary picture elements and picture elements within said boundary.

9. The system of claim 8 wherein said image processing means for detecting the minimum and maximum linear dimension of each object processes said boundary picture elements.

10. The system of claim 8 wherein said image processing means for determining the shape of each object processes the picture elements within said boundary picture elements.

11. The system of claim 10 wherein said image processing means for determining the shape of each object determines the invariant moments of each object.

12. A system for sorting randomly oriented objects of varying sizes based upon the size of the object, the objects having minimum and maximum linear dimensions, the system comprising:

transport means for conveying the objects from an input location to one of a plurality of output locations;

means disposed along said transport means for capturing the image of each object to be sorted, said image capturing means capturing the image of the object represented by a plurality of picture elements, including boundary picture elements and picture elements within said boundary;

image processing means for determining the minimum and maximum linear dimension of each object based upon projections of said boundary pixels;

image processing means for determining the shape of each object based upon said picture elements within said boundary picture elements;

means for selecting either the minimum or maximum linear dimension of the object based upon the determined shape of the object;

means for categorizing the sizes of the object based upon the selected minimum or maximum dimension of the object and for generating a control signal; and means responsive to said control signal for selectively routing the object to one of said plurality of output locations based upon the size of the object.

13. The system of claim 12 wherein said image processing means for determining the shape of each object determines the invariant moment of each object.

14. The system of claim 12 wherein said transport means includes:

first means for receiving and transporting a plurality of objects arranged in a volume from said input location;

second means for receiving and transporting said volume of objects and for arranging the objects into a one dimensional layer of objects;

third means for receiving and transporting said layer of objects and for orientating the objects into a linear array of objects; and fourth means disposed generally perpendicular to said third receiving and transporting means for transporting the objects to one of said plurality of output locations.

15. The system of claim 14 and further including:

means for diverting objects from said third receiving means to said fourth receiving means.

16. The system of claim 15 wherein said fourth receiving and transporting means includes:

a plurality of conveyor belts each for transporting objects to one of said plurality of output locations; and said diverting means includes a plurality of air jets each associated with one of said plurality of conveyor belts.

17. The system of claim 14 wherein said transport means further includes:

fifth means for receiving the objects from said third receiving means and including first and second conveyor belts angularly orientated with respect to each other for transporting the objects to a location adjacent to said image capture means.

18. The system of claim 14 wherein said third receiving means includes a chute having a generally U-shaped cross-sectional shape and means for vibrating said chute.

19. The system of claim 12 wherein said means for determining the minimum and maximum linear dimension of each object generates a projection of said boundary picture elements of the objects in a plurality of different rotational orientations of the object.

20. The system of claim 12 wherein said means for determining the shape of each object generates a plurality of invariant moments.

* * * * *

UNITED STATES PATENT AND TRADEMARK OFFICE

CERTIFICATE OF CORRECTION

PATENT NO. : 5,253,765

DATED : OCTOBER 19, 1993

INVENTOR(S) : ROBERT M. MOOREHEAD ET AL.

It is certified that error appears in the above-identified patent and that said Letters Patent is hereby corrected as shown below:

Column 6, line 8, following "and" insert -- minimum values of the dimensions b and a, are tracked. --

Column 7, line 25, delete "bee" and substitute therefor -- been --.

Signed and Sealed this

Second Day of August, 1994

Bruce Lehman

*Attest:*

BRUCE LEHMAN

*Attesting Officer*

*Commissioner of Patents and Trademarks*